US008771003B2

(12) United States Patent
Reibke et al.

(10) Patent No.: US 8,771,003 B2
(45) Date of Patent: Jul. 8, 2014

(54) ELECTRIC TERMINAL FOR LEADING A CONDUCTOR THROUGH A WALL

(75) Inventors: Heinz Reibke, Bad Salzuflen (DE); Rudolph Merz, Detmold (DE); Guohua Chen, Nanjing (CN); Carsten Lueckheide, Lemgo (DE)

(73) Assignee: Phoenix Contact GmbH & Co. KG (DE)

( * ) Notice: Subject to any disclaimer, the term of this patent is extended or adjusted under 35 U.S.C. 154(b) by 349 days.

(21) Appl. No.: 13/265,365

(22) PCT Filed: Apr. 13, 2010

(86) PCT No.: PCT/EP2010/002262

§ 371 (c)(1),
(2), (4) Date: Jan. 9, 2012

(87) PCT Pub. No.: WO2010/121726

PCT Pub. Date: Oct. 28, 2010

(65) Prior Publication Data

US 2012/0094552 A1 Apr. 19, 2012

(30) Foreign Application Priority Data

Apr. 20, 2009 (DE) ..... 10 2009 017 815

(51) Int. Cl.
*H01R 13/62* (2006.01)

(52) U.S. Cl.
USPC ..... 439/372; 439/564

(58) Field of Classification Search
USPC ..... 439/564–571, 372
See application file for complete search history.

(56) References Cited

U.S. PATENT DOCUMENTS 5,197,903 A 3/1993 Casey et al.
5,449,300 A 9/1995 Yoon (Continued)

FOREIGN PATENT DOCUMENTS

DE 78 13 854 10/1979
DE 36 13 681 6/1987
DE 1 850 425 10/2007

OTHER PUBLICATIONS

International Search Report dated Sep. 28, 2010; PCT/EP2010/002262; International Filing Date: Apr. 13, 2010; Phoenix Contact GmbH & Co. KG; 3 pages.

(Continued)

*Primary Examiner* — Truc Nguyen
(74) *Attorney, Agent, or Firm* — Schmeiser, Olsen & Watts, LLP

(57) ABSTRACT

An electric terminal for leading a conductor through a wall (1), comprising a first terminal piece (2) to be mounted on a first side (3) of the wall (1), and a second terminal piece (4) to be mounted on the second side (5) of the wall (1) is provided. The second terminal piece (4) or the first terminal piece (2) can be fastened to the wall (1) using a fastening means (6) that can be inserted through the wall (1) into the first terminal piece (2) or the second terminal piece (4) from the first side (3) or the second side (5) of the wall (1), and/or the fastening means (6) can be interlocked with the second terminal piece (4) or the first terminal piece (2) in such a way that the second terminal piece (4) or the first terminal piece (2) can be fastened to the wall (1) from the second side (5) or the first side (3) of the wall (1). According to the invention, such an electric terminal for leading a conductor through a wall (1) can be fastened to the wall (1) in a particularly simple fashion.

15 Claims, 2 Drawing Sheets

(56) References Cited

U.S. PATENT DOCUMENTS

Figure 1:
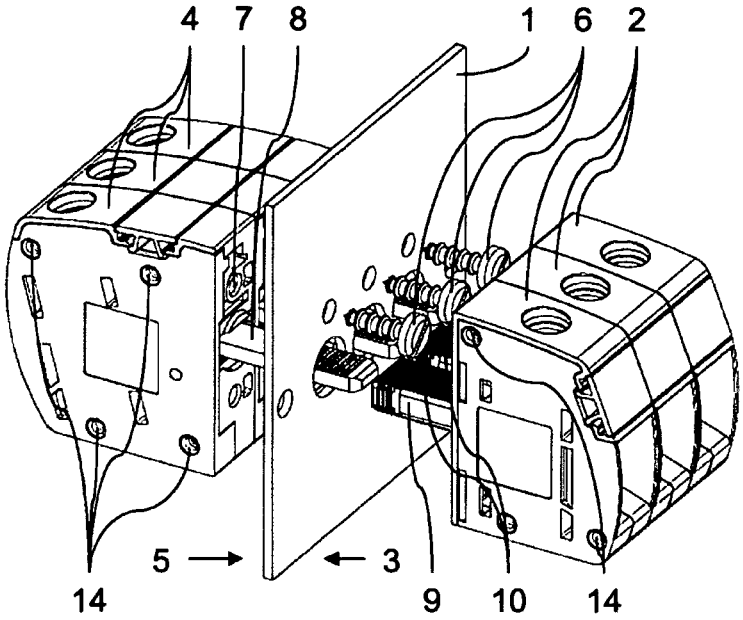

| | | | | |
|---|---|---|---|---|
| 5,562,493 | A * | 10/1996 | Ferrill et al. | 439/536 |
| 7,563,122 | B2 * | 7/2009 | Goetze et al. | 439/372 |
| 7,731,532 | B2 * | 6/2010 | Masumoto et al. | 439/607.1 |
| 7,960,649 | B2 | 6/2011 | Giefers | |
| 2008/0287013 | A1 * | 11/2008 | Masumoto et al. | 439/874 |
| 2009/0130898 | A1 * | 5/2009 | Croteau et al. | 439/571 |
| 2010/0173520 | A1 * | 7/2010 | Weidner | 439/564 |

OTHER PUBLICATIONS

Anonymous: "High VoltageHochstrom-Durchführungsklemmen" Internet Citation; Apr. 15, 2003, pp. 1-6; Retrieved from the Internet: URL:http://www.onlinecomponents.com/productfiles/mr-PH/phoenix_0717238_3.pdf.

International Search Report dated Jan. 27, 2011; PCT/EP2010/002264; International Filing Date: Apr. 13, 2010; Phoenix Contact GmbH & Co. KG; 6 pages.

Written Opinion of the International Searching Authority; PCT/EP2010/002262; International Filing Date: Apr. 13, 2010; Phoenix Contact GmbH & Co. KG; 7 pages.

International Preliminary Report on Patentability dated Oct. 25, 2011; PCT/EP2010/002262; International Filing Date: Apr. 13, 2010; Phoenix Contact GmbH & Co. KG; 8 pages.

Written Opinion; PCT/EP2010/002264; International Filing Date: Apr. 13, 2010; Phoenix Contact GmbH & Co. KG; 14 pages.

International Preliminary Report on Patentability; PCT/EP2010/002264; International Filing Date: Apr. 13, 2010; Phoenix Contact GmbH & Co. KG; 15 pages.

* cited by examiner

ELECTRIC TERMINAL FOR LEADING A CONDUCTOR THROUGH A WALL

FIELD OF TECHNOLOGY

The following relates to an electric terminal for leading a conductor through a wall, comprising a first terminal piece to be mounted on a first side of the wall and a second terminal piece to be mounted at the second side of the wall.

BACKGROUND

Electric terminals are of great importance in various applications, such as in industrial conducting technology, and serve for example to connect electric components. Electric terminals of the type in question have been developed preferably for devices with closed housings and are known as so-called lead-through terminals to lead a conductor through a wall of the housing.

From prior art lead-through terminals are known in which the first terminal is arranged in an interior area of the housing as an interior terminal and the second terminal in an exterior area of the housing as an exterior terminal. Further, from prior art lead-through terminals are known in which an insulating part provided at the interior side of the housing latches to or engages the insulating part of the exterior terminal through a wall opening. Frequently the interior terminal and/or the exterior terminal comprise a screw-connection body, a connection pin, a soldered connection, a blade terminal, or an angular connection for contacting the conductor.

The known lead-through terminals explained above can frequently be fastened for assembly at the wall such that a pin attached at the first terminal positions the first terminal in the wall, with the pin projecting through an opening in the wall into a recess of the second terminal so that the first terminal and the second terminal can be positioned at the wall, mutually aligned to each other, and/or can be connected to each other.

Such devices of prior art for alignment and/or assembly of the lead-through terminal at the wall are however characterized in the first terminal and the second terminal during the assembly, for example by an unintentional motion of the installer, can become distorted or displaced in the opening of the housing wall and thus after the finished assembly they are no longer aligned uniformly straight and/or parallel in reference to each other.

Furthermore it is disadvantageous in lead-through terminals of prior art that the assembly of the first terminal and the second terminal at the wall is frequently difficult due to a lack of a direct assembly access, and the assembly in large housings or switch boxes frequently must occur in two steps. In a first step the first terminal is arranged at one side of the wall, followed by a second step in which the second terminal must be fastened at the wall from the second side. In large housings, in which the first terminal cannot be simultaneously mounted and thus held fixed by the installer from the first side of the wall and the second terminal from the second side of the wall frequently the "plugging on" of the second terminal from the second side of the wall onto the first terminal leads to the first terminal separating from the wall and the assembly then has to begin from the start.

Thus, the following provides an electric terminal for leading a conductor through a wall, which can be assembled and/or fastened at the wall in a simple fashion.

Accordingly, the following provides an electric terminal to lead a conductor through a wall, having a first terminal for assembly at a first side of the wall and a second terminal for the assembly at the second side of the wall, with the second terminal and/or the first terminal can be fastened via a fastening means at the wall and the fastening means can be inserted from the first side and/or the second side of the wall through said wall into the second terminal and/or into the first terminal and/or the fastening means can latch the second terminal and/or the first terminal such that the second terminal and/or the first terminal can be fastened to said wall from the second side and/or the first side of the wall.

SUMMARY

According to the invention, such an electric terminal for leading a conductor through a wall is provided, which can be fastened at the wall in a particularly simple fashion. Furthermore, the electric terminal according to the invention allows a secure straight and/or parallel arrangement of the first terminal in reference to the second terminal, on the one hand during the assembly of the electric terminal as well as on the other hand after the assembly has occurred in a subsequent operating state. Due to the fact that the second terminal and/or the first terminal can be fastened at the wall with a fastening means the first terminal and/or the second terminal can be connected during the assembly in a simple and secure fashion to the second terminal and/or the first terminal without the second terminal and/or the first terminal potentially separating from the wall.

Furthermore, the electric terminal according to the invention allows a very simple assembly sequence, which for example is advantageous in large housing or switch boxes, in which an installer cannot simultaneously fasten the first terminal from one side of the wall and the second terminal from the second side of the wall and here holding them fixed during the assembly. Thus, in a first step the installer can fasten the second terminal and/or the first terminal with a fastening means at the wall and then in a second step "plug on" the first terminal and/or the second terminal onto the second terminal and/or the first terminal. For example, the second terminal can be fastened at the first side of the wall via a fastening means lead through the wall to the second side of the wall and/or the second terminal via another fastening means, which latches at the second terminal, can be fastened at the wall from the second side. Furthermore it is preferred that the first terminal is fastened at the first side of the wall as an interior terminal at an interior side of the wall and the second terminal at the second side of the wall as an exterior terminal at the exterior side of the wall.

In general, the fastening means may be embodied arbitrarily. According to a preferred further development of the invention it is provided, though, that the fastening means are embodied as a screw or a rivet. In this context it is furthermore preferred that the screw is embodied as a self-tapping screw. Thus, for example the second terminal, preferably embodied as the exterior terminal, can be fastened from the first side of the wall, i.e. preferably the interior side of the wall, through the wall using a self-tapping screw at the wall such that the self-tapping screw is "screwed in" through the wall into the exterior terminal. Furthermore, the exterior terminal can be attached from the exterior side of the wall, which for example represents a switch box, to the wall of said switch box and then be fastened at the wall of said switch box by a self-tapping screw from the interior side of the switch box such that the self-tapping screw is "screwed in" from the interior side of the wall of the switch box into the exterior terminal. Additionally, it is possible to fasten the exterior terminal with a rivet to the wall of the switch box, lead through the wall of the switch box from the interior of the wall of the switch box.

According to another preferred embodiment of the invention an arrangement is provided inside the second terminal and/or the first terminal to accept the fastening means and/or to fasten said fastening means. Such a device for accepting the fastening means and/or for fastening the fastening means may be embodied, for example, as a threaded dome so that in a potential embodiment a metric screw can be screwed in through the wall into a metric thread, for example a threaded bolt, in order to fasten the terminal at the wall.

Furthermore, according to a further development of the invention it is particularly preferred that the fastening means that can be inserted from the first side and/or the second side of the wall through said wall into the second terminal and/or the first terminal in the plugged-in state of the electric terminal is covered by the first terminal and/or the second terminal. In other words, it is preferred that in the plugged-in state of the electric terminal the fastening means is covered by the first electric terminal and/or the second electric terminal such that no additional space is required by the fastening means, for example above or below the terminal. This way, the size of the terminal housing remains unaffected by the fastening means, which leads to a simple and cost-effective production of the terminal.

According to a preferred further development of the invention it is further provided that the first terminal and/or the second terminal each comprise a latch for latching two terminals with each other. In this context it is furthermore preferred that the latching means is embodied as a latching pin that can engage a latching hole or as a latching hole that can be engaged by a latching pin. Such an embodiment allows in a simple fashion to achieve a secure, straight and/or parallel arrangement of two terminals in reference to each other, thus for example a simple latching of two exterior terminals with each other. This way it is possible, for example, to fasten a first exterior terminal via the fastening means to the wall and via the respective latching means fasten additional exterior terminals to the first exterior terminal. Furthermore, in this context it is preferred that the latching means are injection molded at a lateral wall of the first terminal and/or the second terminal, with the latching means generally may be embodied arbitrarily and provided at an arbitrary position of the first terminal and/or the second terminal.

According to another preferred further development of the invention it is provided that the fastening means that can be mounted to the terminal is detachable from said terminal. Furthermore it is preferred that the fastening means that can be assembled is embodied as a flange that can be latched, which for example can latch laterally from the second terminal and/or the first terminal. Furthermore, it is preferred that the fastening means that can be assembled comprises a screw or a rivet and can be fastened at the wall via the screw or rivet, for example a self-tapping screw.

According to a preferred further embodiment of the invention it is provided that the first terminal and/or the second terminal comprise a connection element and the connection element can be inserted into the second terminal and/or the first terminal. In general, the connection element may show an arbitrary profile. However, it is preferred that the connection element shows a rectangular or tubular profile. According to another preferred embodiment of the invention it is further provided that the second terminal and/or the first terminal comprise a conductor line for the electric connection to the first terminal and/or second terminal. In this context, it is furthermore preferred that the conductor line shows a rectangular profile and/or that the conductor line can be inserted into the connection element so that the connection element can contact the conductor line in a form-fitting fashion.

In general, the connection element may be embodied arbitrarily, though. According to a preferred further development of the invention it is provided that the connection element comprises an at least partially alternating groove-like and spring-like structuring and/or a gear-like structuring at the surface of the connection elements facing away from the conductor line. Furthermore it is preferred that the surface of the connection elements facing away from the conductor line show an at least partially edged structuring and/or a rib-like structuring. Such an embodiment enlarges the creep distance, particularly in reference to a surface with a planar shape, so that the electric terminal according to the invention can be impinged with higher voltages, particularly in reference to an electric terminal with a planar surface of the connection element.

According to a preferred further development of the invention it is also provided that the first terminal comprises a first connection body, the second terminal a second connection body, the conductor lines are connected in a fixed manner to the second connection body and/or the first connection body and the conductor lines are detachably connected to the second connection body and/or the first connection body. Furthermore, in this context it is preferred that a detachable connection of the conductor line to the first connection body and/or to the second connection body can be created by way of clamping.

In general, the first connection body and/or the second connection body may be embodied as spring-loaded connection bodies or connection pins of any design. According to a preferred further development of the invention it is provided, though, that the first connection body and/or the second connection body are embodied as screw-connection bodies. Here the sizing of the first connection body, the second connection body, and/or the conductor line may occur based on the conduction of currents and/or voltages expected.

BRIEF DESCRIPTION

Figure 2:
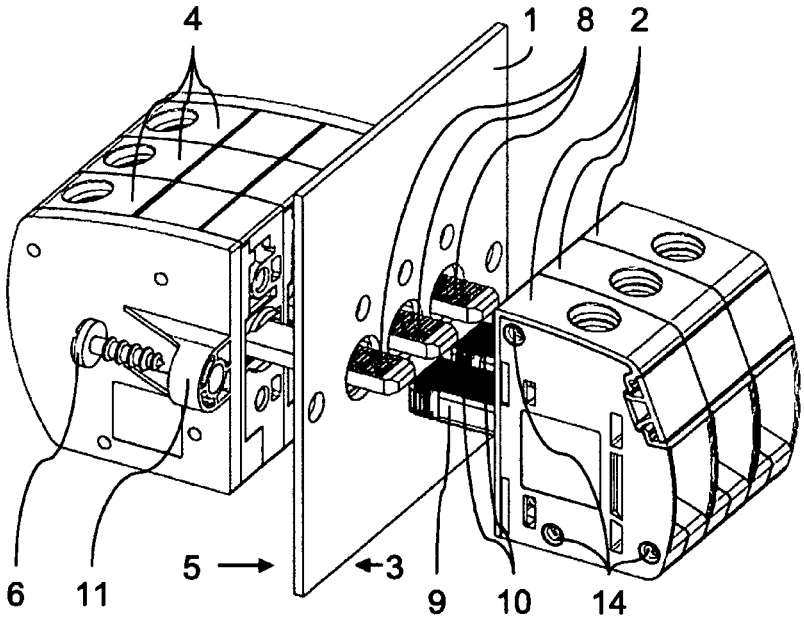
Figure 3:
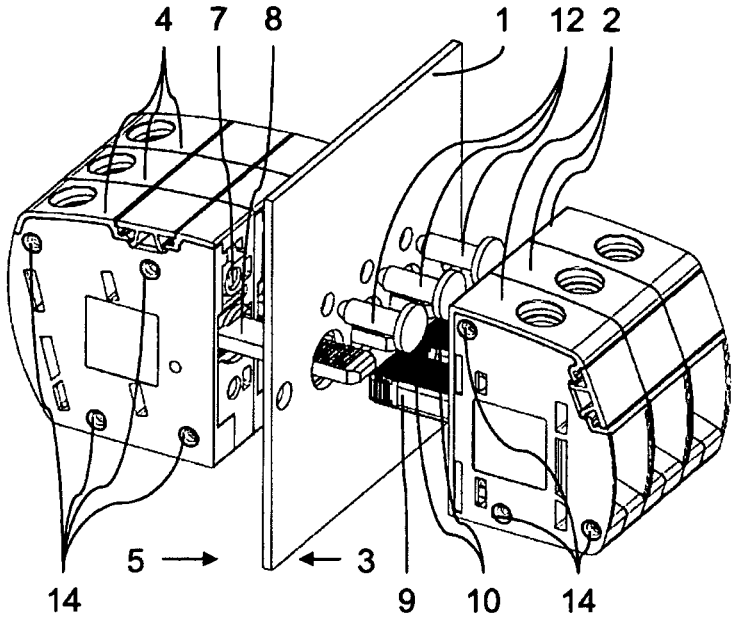
Figure 4:
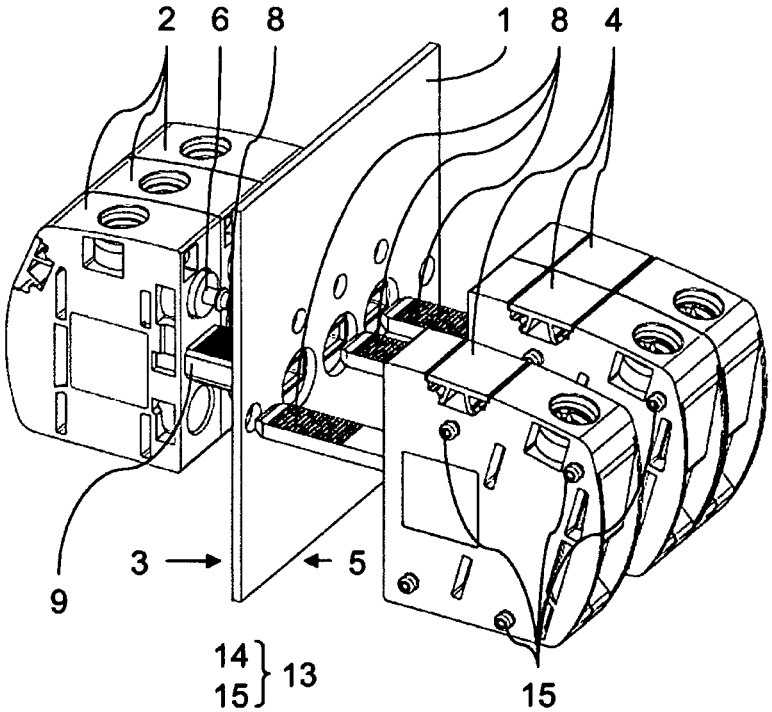

In the following, the invention is explained in greater detail with reference to the drawing. The drawing shows:

FIG. 1 an electric terminal in the un-plugged state according to a preferred embodiment of the invention, in a perspective view, FIG. 2 an electric terminal in the un-plugged state according to another preferred embodiment of the invention in another perspective view, FIG. 3 an electric terminal in the un-plugged state according to another preferred embodiment of the invention in another perspective view, and FIG. 4 an electric terminal in the un-plugged state according to another preferred exemplary embodiment of the invention in another perspective view.

DETAILED DESCRIPTION

From FIGS. 1 through 4 an electric terminal is discernible to lead a conductor through a wall 1, having a first terminal 2 for fastening at the first side 3 of the wall 1 and another second terminal 4 for fastening at the second side 5 of the wall 1.

In general, the second terminal 4 can be fastened at an interior side of the wall 1 as an interior terminal and the first terminal 2 at an exterior side of the wall 1 as an exterior terminal, however it is preferred to arrange the first terminal 2 as an interior terminal at the interior side of the wall 1 and the second terminal 4 as an exterior terminal at the exterior side of the wall 1. The wall 1 may represent, for example, a metallic wall 1 of an electric installation socket or a switch box.

As discernible from FIG. 1, the second terminal 4 can be fastened at the wall 1 via a fastening means 6, which presently is embodied as a self-tapping screw. For this purpose, the fastening means 6 can be inserted from the first side 3 of the wall 1 through the wall 1 into an arrangement 7 for accepting the fastening means 6 of the second terminal 4. In other words, the second terminal 4 can be fastened via a self-tapping screw at the wall 1, with the self-tapping screw can be "screwed in" through the wall 1 into the second terminal 4. This way it is possible to fasten the second terminal 4 in a secure and/or predefined position at the wall 1 in a simple fashion. Subsequently the first terminal 2 can be "plugged on" the second terminal 4 so that the first terminal 2 covers the fastening means 6 in such a plugged-in state of the electric terminal.

In order to connect the first terminal 2 with the second terminal 4 the second terminal 2 comprises a conductor line 8, which can be inserted into a connection element 9 of the first terminal 2. The conductor line 8 serves for the production of an electric connection between the first terminal 2 and the second terminal 4. In order to connect a wire to the first terminal 2 and/or the second terminal 4 the first terminal 2 and/or the second terminal 4 may comprise a connective body, not shown, which is connected in a fixed or detachable fashion to the conductor line 8. The conductor line 8 is embodied as a metallic conductor line, for example.

As furthermore discernible from FIG. 1, the surface of the connection element 9 facing away from the conductor line 8 comprises an at least partially alternating and spring-like structuring 10, which acts like an "extension of the creep current", thus allowing the impingement of the electric terminal with a higher current and/or a higher voltage, particularly in reference to a surface of a connection element 9 showing a planar shape.

FIG. 2 shows another preferred exemplary embodiment of the invention with a fastening means 6 that can latch at the second terminal 4, which is embodied here as a latchable flange 11. Using such a latchable flange 11 the second terminal 4 can be fastened from the second side 5 of the wall 1 to said wall 1. For this purpose, the latchable flange 11 can be fastened at the second terminal 4 and, for example as discernible from FIG. 2, fastened with a self-tapping screw at the wall 1.

According to another preferred exemplary embodiment of the invention, as discernible from FIG. 3, the fastening means 6 can be embodied as a rivet 12, with the rivet 12 can be inserted from the first side 3 of the wall 1 in the direction 7 to accept the fastening means 6 and/or for fastening the fastening means 6 of the second terminal 4. Embodied in this fashion, the second terminal 4 can be fastened at the wall 1 in an easy fashion so that a secure straight and/or parallel arrangement can be achieved of one or more terminals 2, 4 at an electric terminal.

Additionally, according to another preferred exemplary embodiment of the invention two terminals 2, 4 can be latched to each other by a latching means 13. In the present case, the latching means 13 is embodied as a latching hole 14 and/or latching pin 15, with the latching hole 14 can engage the latching pin 15. Accordingly, for example as discernible from FIG. 4, two second terminals 4 can engage each other via the latching means 13, with the latching means 13 each being injection-molded to one side of the second terminal 4 so that at one side of the second terminal 4 the latching pin 15 is provided and the latching hole 14 is provided at the other side of the second terminal 4.

As a result, an electric terminal is provided to lead a conductor through a wall 1, which allows a simple assembly at the wall 1, with for example in a first step the second terminal 4 can be fixed at the wall 1 via the fastening means 6 and in a second step the first terminal 2 "can be plugged on" the second terminal 4. This way, a simple and secure assembly is allowed by the electric terminal, which also allows a parallel arrangement of several terminals 2, 4.

LIST OF REFERENCE CHARACTERS

Wall 1
First terminal 2
First side 3
Second terminal 4
Second side 5
Fastening means 6
Arrangement 7
Conductor line 9
Connection element 10
Structuring 11
Flange 12
Rivet 13
Latching hole 14
Latching pin 15

The invention claimed is:

1. An electric terminal for leading a conductor through a wall, the electric terminal comprising:

a first terminal for fastening at a first side of the wall and a second terminal for fastening at a second side of the wall;

wherein at least one of the second terminal and the first terminal is fastened via a fastening means at the wall, and the fastening means is inserted from at least one of the first side and the second side of the wall through the wall into at least one of the first terminal and the second terminal;

wherein the fastening means latches at at least one of the second terminal and the first terminal such that at least one of the second terminal and the first terminal is fastened at the wall from at least one of the second side and the first side of the wall;

wherein at least one of the first terminal and the second terminal includes a connection element, further wherein the connection element is inserted into at least one of the second terminal and the first terminal;

wherein the connection element includes at least one of an at least partially alternating groove-like and spring-like structuring and a gear-like structuring of a surface of the connection element facing away from the conductor line.

2. An electric terminal according to claim 1, wherein the fastening means being embodied as a screw or a rivet.

3. An electric terminal according to claim 2, wherein the screw is as a self-tapping screw.

4. An electric terminal according to claim 1, with an arrangement being provided within at least one of the second terminal and the first terminal to at least one of accept the fastening means and fasten the fastening means.

5. An electric terminal according claim 1, wherein the fastening means, which is inserted from at least one of the first side and the second side of the wall, through said wall into at least one of the second terminal and the first terminal being covered in an inserted state of the electric terminal by at least one of the first terminal and the second terminal.

6. An electric terminal according to claim 1, wherein at least one of the first terminal and the second terminal each comprise a latching means for latching two terminals with each other.

7. An electric terminal according to claim 6, wherein the latching means is a latching pin that engages at least one of a latching hole and latching pin.

8. An electric terminal according to claim 6, wherein the latching means is injection molded to a lateral wall of at least one of the first terminal and the second terminal.

9. An electric terminal according to claim 1, wherein the fastening means is detachable from said terminal.

10. An electric terminal according to claim 1, wherein at least one of the second terminal and the first terminal includes a conductor line for an electric connection to at least one of the first terminal and the second terminal.

11. An electric terminal according to claim 10, wherein the conductor line is inserted into the connection element.

12. An electric terminal according to claim 1, wherein the first terminal includes a first connection body, the second terminal includes a second connection body, a conductor line is connected fixed to at least one of the second connection body and the first connection body, and the conductor line is detachably connected to at least one of the second connection body and the first connection body.

13. An electric terminal according to claim 12, wherein at least one of the first connection body and the second connection body is a screw-connection body.

14. An electric terminal for leading a conductor through a wall the electric terminal comprising:

a first terminal for fastening at a first side of the wall and a second terminal for fastening at a second side of the wall;

wherein at least one of the second terminal and the first terminal is fastened via a fastening means at the wall, and the fastening means is inserted from at least one of the first side and the second side of the wall through the wall into at least one of the first terminal and the second terminal;

wherein the fastening means latches at at least one of the second terminal and the first terminal such that at least one of the second terminal and the first terminal is fastened at the wall from at least one of the second side and the first side of the wall;

wherein the fastening means is a self-tapping screw.

15. An electric terminal for leading a conductor through a wall the electric terminal comprising:

a first terminal for fastening at a first side of the wall and a second terminal for fastening at a second side of the wall;

wherein at least one of the second terminal and the first terminal is fastened via a fastening means at the wall, and the fastening means is inserted from at least one of the first side and the second side of the wall through the wall into at least one of the first terminal and the second terminal;

wherein the fastening means latches at at least one of the second terminal and the first terminal such that at least one of the second terminal and the first terminal is fastened at the wall from at least one of the second side and the first side of the wall;

wherein at least one of the first terminal and the second terminal each comprise a latching means for latching two terminals with each other;

wherein the latching means is injection molded to a lateral wall of at least one of the first terminal and the second terminal.

* * * * *

UNITED STATES PATENT AND TRADEMARK OFFICE

CERTIFICATE OF CORRECTION

PATENT NO. : 8,771,003 B2
APPLICATION NO. : 13/265365
DATED : July 8, 2014
INVENTOR(S) : Heinz Reibke et al.

It is certified that error appears in the above-identified patent and that said Letters Patent is hereby corrected as shown below:

Title Page
INVENTORS
Delete "Rudolph Merz" and insert --Rudolf Merz--

In the Specification
COLUMN 5
Line 17, after "terminal 4", delete "the second terminal 2", and insert --the second terminal 4--

COLUMN 6
Line 8, delete the List of Reference Characters chart and replace with the following chart:

LIST OF REFERENCE CHARACTERS

Wall 1
First terminal 2
First side 3
Second terminal 4
Second side 5
Fastening means 6
Arrangement 7
Conductor line 8
Connection element 9
Structuring 10
Flange 11
Rivet 12
Latching means 13
Latching hole 14
Latching pin 15

Signed and Sealed this
Thirteenth Day of January, 2015

Michelle K. Lee

Michelle K. Lee
*Deputy Director of the United States Patent and Trademark Office*